US009500201B2

(12) United States Patent
Hütten et al.

(10) Patent No.: US 9,500,201 B2
(45) Date of Patent: Nov. 22, 2016

(54) GEARED COMPRESSOR ROTOR FOR COLD GAS APPLICATIONS

(75) Inventors: Volker Hütten, Moers (DE); Andreas Peters, Xanten (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 511 days.

(21) Appl. No.: 13/262,026

(22) PCT Filed: Mar. 26, 2010

(86) PCT No.: PCT/EP2010/054004

§ 371 (c)(1),
(2), (4) Date: Sep. 29, 2011

(87) PCT Pub. No.: WO2010/112423

PCT Pub. Date: Oct. 7, 2010

(65) Prior Publication Data

US 2012/0039722 A1 Feb. 16, 2012

(30) Foreign Application Priority Data

Apr. 1, 2009 (DE) ..... 10 2009 015 862

(51) Int. Cl.

| | |
|---|---|
| ***F04D 7/02*** | (2006.01) |
| ***F04D 29/02*** | (2006.01) |
| ***F04D 29/10*** | (2006.01) |
| ***F04D 29/26*** | (2006.01) |

(52) U.S. Cl.

CPC ..... *F04D 29/023* (2013.01); *F04D 29/102* (2013.01); *F04D 29/266* (2013.01); *F05D 2300/502* (2013.01); *F05D 2300/506* (2013.01)

(58) Field of Classification Search

CPC .. F04D 29/023; F04D 29/266; F04D 29/102; F04D 29/60; F01D 5/026; F05D 2300/50212; F05D 2300/5023

USPC ..... 415/244 A, 229, 230, 216.1, 217.1, 415/215.1; 416/244 R, 223 R

See application file for complete search history.

(56) References Cited

U.S. PATENT DOCUMENTS

| | | | | |
|---|---|---|---|---|
| 1,808,792 | A | 6/1931 | Schellens | |
| 1,853,973 | A | 4/1932 | Hoffmann | |
| 3,874,824 | A * | 4/1975 | Cronstedt et al. | 417/406 |
| 5,482,437 | A | 1/1996 | Houston et al. | |
| 5,830,293 | A * | 11/1998 | Meyer et al. | 148/654 |
| 7,909,578 | B2 * | 3/2011 | Nishiyama et al. | 416/204 A |
| 2004/0012288 | A1 * | 1/2004 | Steinmeyer | 310/90.5 |
| 2005/0189772 | A1 * | 9/2005 | Gozdawa | 290/52 |

FOREIGN PATENT DOCUMENTS

DE 4220127 C1 9/1993

* cited by examiner

*Primary Examiner* — John K Fristoe, Jr.
*Assistant Examiner* — Brian O Peters

(57) ABSTRACT

A geared compressor rotor for cold gas applications is provided. The geared compressor rotor includes a pinion shaft having a gear tooth segment having gear teeth. The rotor further includes at least one impeller wheel having an impeller wheel hub and a sealing segment arranged between the gear tooth segment and the impeller wheel hub that bears a seal. The impeller wheel hub and the sealing segment form a common, continuously coherent region composed of a first material. The toothing segment is formed from a second material. The first material is tougher at subzero temperatures than the second material.

6 Claims, 1 Drawing Sheet

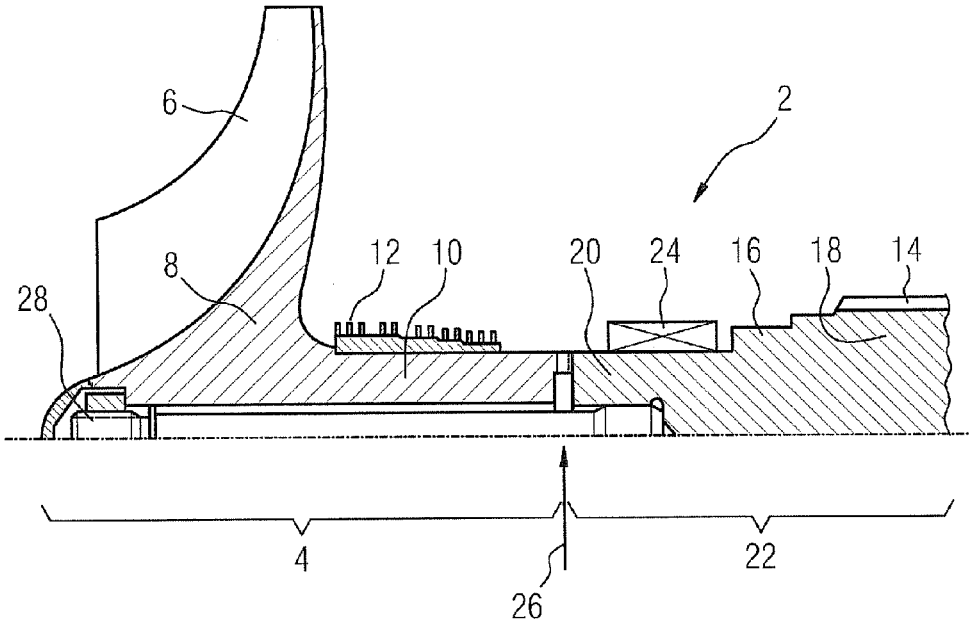
6
2
8
12
10
20
24
16
18
14
28
4
22
26

GEARED COMPRESSOR ROTOR FOR COLD GAS APPLICATIONS

CROSS REFERENCE TO RELATED APPLICATIONS

This application is the US National Stage of International Application No. PCT/EP2010/054004, filed Mar. 26, 2010 and claims the benefit thereof. The International Application claims the benefits of German application No. 10 2009 015 862.6 filed Apr. 1, 2009. All of the applications are incorporated by reference herein in their entirety.

FIELD OF INVENTION

The invention relates to a geared compressor rotor for cold gas applications having a pinion shaft with a toothing segment with a toothing, at least one impeller wheel with an impeller wheel hub and a sealing segment which is arranged between the toothing segment and the impeller wheel hub and bears a seal.

BACKGROUND OF INVENTION

Turbocompressors are used in a variety of ways in industry and in power generation. For example, geared compressors are used for air fractionation in which oxygen and nitrogen from ambient air are separated from one another. For this purpose, an air compressor sucks in the filtered air and compresses it to the necessary pressure. The air is then cooled and fractionated into the main components, that is to say into nitrogen and oxygen as well as into a small proportion of noble gas. Compressor units then compress the oxygen and nitrogen in order, for example, to feed them into a line system for further use.

During the compression of oxygen, lubricant oil for the bearings of the compressor rotor and the delivery medium oxygen have to be carefully separated from one another because of the risk of explosion. For this reason, a labyrinth gasket, in particular a multi-chamber gasket, is usually arranged between a bearing and an impeller wheel which brings about the compression in order to separate the gas and in order to maintain the process-side pressure.

As a result of the cooling and subsequent fractionation of the air, the impeller wheel of the turbocompressor is subject to very low temperatures of below −30° C. In other gas separation processes, temperatures below −150° C. can be reached. In order to avoid brittle fracture behavior at such low temperatures, materials which are tough at subzero temperatures have to be used for the manufacture of the impeller wheel. If low temperatures are implemented in a geared compressor, not only the impeller wheels but also the rotor shaft have to be protected against brittle fracture within the seal-forming regions as far as the bearing points owing to the low operating temperature.

The impeller wheel or impeller wheels and the rotor shaft in the seal-forming region are usually fabricated from a high-alloyed steel which is tough at subzero temperatures in cold gas applications. For reasons of ease of manufacture and of mounting, the pinion shaft and impeller wheels are implemented separately. So that the pinion shaft or the rotor shaft satisfies stringent mechanical requirements in the toothing region, it is known to manufacture the pinion shaft from a material other than that of the impeller wheel or the hub thereof.

U.S. Pat. No. 1,808,792A, U.S. Pat. No. 3,874,824A, U.S. Pat. No. 1,853,973A and U.S. Pat. No. 5,482,437A have already disclosed compressors of the type defined at the beginning, which have a restricted suitability for operation at low temperatures.

SUMMARY OF INVENTION

An object of the present invention is to disclose a geared compressor rotor for a turbocompressor which has a high level of strength in low temperature applications.

This object is achieved by means of a geared compressor rotor of the type mentioned at the beginning, in which according to the invention the sealing segment and the impeller wheel hub, in particular the entire impeller wheel, form a common, continuously coherent region which is composed of a first material, and the toothing segment is formed from a second material. As a result, a large region of the rotor is fabricated from the first material, and the properties of said region have to be adapted to the operating conditions of the impeller wheel. The risk of embrittlement at low temperatures can be avoided with this design. Furthermore, the connecting point between the two materials is positioned very far inward into the operationally warm region. The toothing segment is in the operationally warn region and can be embodied from a conventional toothing material. This gives rise to very small transmission dimensions and therefore to low costs and also low mechanical losses.

The turbocompressor is expediently a geared compressor. The toothing segment can be part of a transmission which mechanically connects the geared compressor rotor to a drive, for example an electric motor. The sealing segment can bear part or half of a seal, in particular of a labyrinth gasket for sealing the surroundings of the compressor region or impeller wheel with respect to a bearing of the rotor, in particular an oil-carrying bearing.

The impeller wheel is expediently part of an overhang stage of the turbocompressor and is expediently mounted in a cantilevered fashion. As a result, the impeller wheel only has to be sealed on one side with respect to a rotor bearing, so that the expenditure on sealing is kept low.

The geared compressor rotor is particularly suitable for use in the low temperature range of −30° C. and lower if the first material is a material which is tough at subzero temperatures, and is tougher at subzero temperatures than the second material. The impeller wheel is as a result particularly well protected against brittle fracture behavior, while the inner region of the rotor shaft can be embodied in accordance with the requirements made of it. The first material is, in particular, a material which is tough at subzero temperatures, such as is defined in the standard EN 10.269 for example.

The second material is advantageously harder or higher strength than the first material. The second material can be a case-hardened, nitrided or highly tempered steel, as a result of which the stringent mechanical demands made of a transmission are met.

In a further advantageous embodiment of the invention, a rotor bearing is arranged in the region of the second material. The second material can be protected against excessive cooling by thermal input by the rotor bearing.

The rotor bearing can be a radial bearing which is embodied, in particular, as a hydrodynamic sliding bearing. Such a bearing can be supplied with warm lubrication oil or at a temperature of, for example, 45° C., as a result of which there is a high thermal input by the rotor bearing into the rotor. As a result of this thermal input, the toothing region composed of the second material can be protected against excessive cooling. The arrangement of the rotor bearing in the region of the second material also avoids an unnecessary higher degree of heating of the first material and therefore of the axially outer part of the rotor.

The shaft bearing is advantageously arranged between the sealing segment and the toothing segment. Stable cantilevered bearing of the rotor can be achieved by supporting the rotor outside the toothing.

The two material regions are expediently connected to one another in a rotationally fixed fashion. This rotationally fixed connection can be achieved by means of a materially joined connection such as, for example, a welded connection, a frictionally locking connection such as, for example, a clutch or a positively locking connection. This connection is advantageously formed by spur gearing, with the result that the two material regions engage one in the other in a positively locking fashion. The risk of unbalance due to a welded connection or of slipping of the two regions with respect to one another as a result of an insufficiently secure frictionally locking connection can be avoided. The rotationally fixed connection is advantageously arranged between the sealing segment and a rotor bearing, for example the radial bearing.

A Hirth coupling is particularly suitable as a rotationally fixed connection between the two rotor regions or material regions of the rotor. The Hirth toothing of the Hirth coupling ensures a secure, self-centering and releasable connection using simple means. The teeth of the Hirth toothing bear one against the other in a static and planar fashion in the sense of a frictionally locking coupling, and are radially oriented, which brings about the centering. By using the Hirth coupling, a connection can be brought about between the rotor regions which is very small in size. The frictional engagement requires axial tension, which in turn limits the transmission of force from one region to the other.

DETAILED DESCRIPTION OF INVENTION

The invention will be explained in more detail on the basis of an exemplary embodiment which is illustrated in a drawing. The single FIGURE of the drawing shows a section of a geared compressor rotor 2 whose axially outer region 4 comprises an impeller wheel 6 with an impeller wheel hub 8 and a sealing segment 10 with a gasket 12 in the form of a labyrinth gasket. The impeller wheel 6 is mounted in a cantilevered fashion and is part of an overhang stage of the geared compressor.

The geared compressor rotor 2 can be embodied either with one impeller wheel or with two impeller wheels. In a design with two impeller wheels, FIG. 1 can be considered to be a half illustration with a mirror plane in the toothing region. In one embodiment with just one impeller wheel, the pinion shaft 16 ends with the second bearing region (not illustrated) which is located behind the toothing.

The geared compressor rotor 2 is a component of a turbo geared compressor with a transmission which connects, by means of a toothing 14, a drive, for example a steam turbine or an electric motor, for the purpose of transmitting force to the impeller wheel 6. The toothing 14 of the rotor 2 is fabricated on a pinion shaft 16 which can be divided into a toothing segment 18 and into a bearing region 20, which in turn form an inner region 22 of the rotor. In the bearing region 20, the pinion shaft 16 bears a rotor bearing 24 in the form of a radial bearing, specifically a hydrodynamic sliding bearing.

The two regions 4, 22 are connected to one another by means of a positively locking connection 26 which is indicated by an arrow. In the connection 26, the pinion shaft 16 and the impeller wheel 6 are connected to one another in a positively locking and rotationally fixed manner. The connection 26 is embodied as a Hirth coupling, wherein a screwed connection 28 presses the two regions 4, 22 of the geared compressor rotor 2 axially one against the other, with the result that large forces and torques can be transmitted from one region 4 to the other 22 by means of the Hirth coupling.

The two regions 4, 22 are manufactured from different materials. The impeller wheel hub 8 and the sealing segment 10 are manufactured in the outer region 4 from a material which is tough at subzero temperatures, for example the steel X8Ni9 which is tough at subzero temperatures. In this context, the impeller wheel hub 8 and the sealing segment 10 are manufactured as a single-piece component, for example as a forged component. A welded connection between the impeller wheel hub 8 and the sealing segment 10 has also been dispensed with in order to avoid the risk of an unbalance owing to unequal stress distribution.

The inner region 22 and/or the pinion shaft 16 can be manufactured from case-hardened steel, for example 18CrNiMo7-6. A high-strength tempered steel, for example 56NiCrMoV7 is also advantageous. Both the case-hardened steel and the high-strength tempered steel are particularly hard and resistant to abrasion, with the result that the toothing 14 has a long service life. However, these steels are tough at subzero temperatures only to a limited degree, with the result that at very low working temperatures there is the risk of fracture due to embrittlement. The steel which is tough at subzero temperatures in the outer region 4 is particularly suitable for preventing a fracture due to embrittlement, and the rotor shaft 2 is therefore particularly suitable for operation at particularly cold temperatures, for example below −30° C. or below −120° C., for example for air fractionation.

During operation, the rotor bearing 24 is supplied with warm lubrication oil, with the result that the hydrodynamic sliding bearing of the rotor 2 is ensured. The warm lubrication oil transfers heat to the inner region 22 of the rotor 2, with the result that when operation is provided the latter never cools down into a temperature range which entails the risk of brittle fracture behavior of the pinion shaft 16. The arrangement of the connection 26 very far toward the inside in the operationally warm region of the rotor 2 makes the outer region 4, which is composed of first material which is tough at subzero temperatures, very long, with the result that a large part of the rotor 2 is suitable for the low operating temperatures. Despite this large region which is tough at subzero temperatures, the possibility remains, due to the separation of the rotor 2 into the two different regions 4, 22, of manufacturing the toothing segment 16 from a suitable toothing material. As a result, the transmission can be made particularly small in size and resistant to wear.

The invention claimed is:

1. A geared compressor rotor for cold gas applications, comprising:

a pinion shaft comprising a toothing segment having a toothing, at least one impeller wheel comprising an impeller wheel hub, a sealing segment arranged between the toothing segment and the impeller wheel hub and bearing a gasket, wherein the impeller wheel hub and the sealing segment form a common, continuously coherent region composed of a first material, wherein the toothing segment is formed from a second material, and wherein the first material is tougher at subzero temperatures than the second material, wherein a pair of separate and different material regions is defined by the first material and the second material, wherein a rotationally fixed connection is arranged between the pair of separate and different material regions by way of a Hirth coupling effective to transmit an axial force or torque between the pair of separate and different material regions.

2. The geared compressor rotor as claimed in claim 1, wherein the impeller wheel is mounted in a cantilevered fashion.

3. The geared compressor rotor as claimed claim 1, wherein the second material is harder than the first material.

4. The geared compressor rotor as claimed in claim 1, wherein a rotor bearing is arranged in the region of the second material.

5. The geared compressor rotor as claimed in claim 1, wherein a rotor bearing is arranged between the sealing segment and the toothing segment.

6. The geared compressor rotor as claimed in claim 1, wherein the pair of separate and different material regions is arranged between the sealing segment and a rotor bearing.

* * * * *